United States Patent [19]

Lin

[11] 3,990,458

[45] Nov. 9, 1976

[54] PIPE AND TOBACCO PACK

[75] Inventor: Yih Szer Lin, Flushing, N.Y.

[73] Assignee: Lawrence Peska Associates, Inc., New York, N.Y. ; a part interest

[22] Filed: Apr. 25, 1975

[21] Appl. No.: 571,526

[52] U.S. Cl. ..... 131/3; 131/199

[51] Int. Cl.[2] ..... A24D 1/14

[58] Field of Search ..... 131/3, 199

[56] References Cited

UNITED STATES PATENTS

| | | | |
|---|---|---|---|
| 2,991,788 | 7/1961 | Brost | 131/3 |
| 3,292,634 | 12/1966 | Beucler | 131/3 |
| 3,760,814 | 9/1973 | Fether | 131/3 |

FOREIGN PATENTS OR APPLICATIONS

| | | | |
|---|---|---|---|
| 322,995 | 10/1903 | France | 131/199 |
| 5,239 | 1910 | United Kingdom | 131/3 |

*Primary Examiner*—Robert W. Michell
*Assistant Examiner*—V. Millin

[57] ABSTRACT

A dual purpose pipe and tobacco pack, such that the invention results in two effects: (1) providing a tobacco pack for the pipe, and (2) providing a modified pipe, therefore, one may clean out the ashes after smoking easily and always keep the pipe clean. The foregoing accomplished by a two piece bowl formed of complimentary half sections, means connecting the two and a tobacco cartridge comprising a hollow walled cylinder open at one end and including a hollow shank portion communicating with the interior of the bowl of the pipe, the cylinder adapted to receive and retain tobacco.

5 Claims, 4 Drawing Figures

PIPE AND TOBACCO PACK

BACKGROUND OF THE INVENTION

This invention relates to a new and improved pipe, more particularly to a combination pipe and tobacco cartridge, the latter being inserted as a unit into the pipe for smoking, and therafter removed from the pipe, as a unit, subsequent to smoking.

The prior art teaches a variety of pipes and tobacco cartridges therefor, for example: U.S. Pat. Nos. 380,590; 975,584; 1,072,914;2,417,978; 2,543,190; 2,991,788; 3,246,656; 3,275,006; 3,468,314; and others.

These devices are different, however, in that the pipe does not remain uniformly clean during the smoking operation and additionally the tobacco cartridge does not generally form a truly integral portion of the pipe.

SUMMARY OF THE INVENTION

It is accordingly an object of the instant invention to avoid one or more drawbacks of the prior art.

It is another object to provide for a tobacco pack for a pipe in which the tobacco pack may be put in and taken out of the pipe easily.

It is still a further object to provide for a pipe which may be easily kept clean, that means, by using the tobacco pack, there exists a very simple way to remove the ashes after smoking.

These together with other objects and advantages which will become substantially apparent, in the details of construction and operation as more fully hereinafter described and claimed, reference being had to the accompanying drawings, forming a part hereof, wherein like numerals refer to like parts throughout, and in which:

Figure 1:
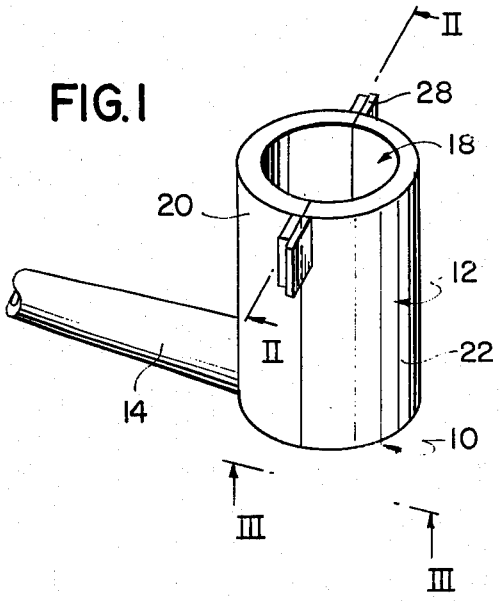
FIG. 1 is a side elevational view of the pipe.
Figure 2:
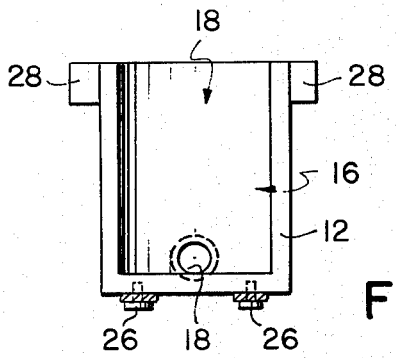
FIG. 2 is a sectional view taken along the line II—II of FIG. 1.
Figure 4:
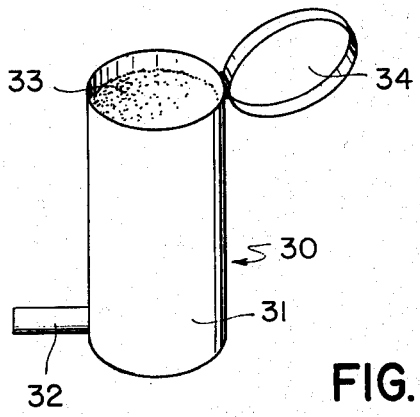
FIG. 4 is a side elevational view of the tobacco cartridge, partly in perspective.
Figure 3:
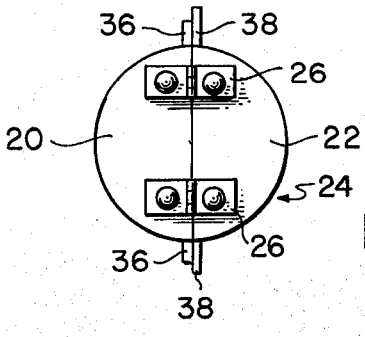
FIG. 3 is a bottom plan view.

Broadly speaking, the instant invention includes the provision of in a smoking pipe including a hollow bowl and stem portion having a mouth piece, the portion defining a bore communicating with the bowl and having a central axis perpendicular to the central axis of said bore, a two piece bowl formed of complimentary half sections, hinge means connecting the two half sections and being disposed along the longitudinal line on the underside of the bowl, at least one pair of releasably engaging connecting means adjacent the vertical longitudinal axis of the bowl sections, each member of the pair being disposed approximately 180° from the other member and on a different bowl section, a tobacco cartridge adapted to receive and contain tobacco comprising a hollow walled cylinder open at one end and including a hollow shank portion at the lower end of the cylinder, the shank portion being perpendicular to said bowl and said cylinder communicating with the interior of the cylinder and being adapted to mate with the bore whereby a draft is created between the tobacco in the cartridge and the mouthpiece of the pipe.

DETAILED DESCRIPTION

Referring more particularly to the drawings, there is shown a pipe bowl end 10, of a smoking pipe illustrating as having a bowl 12 preferably or cylindrical shape and a pipe stem 14 portion laterally projecting from the end of the lower portion of the bowl 12. An internal chamber 16 and open mouth 18 is provided in the bowl 12. The stem portion 14 is provided with a channel or bore 18 that is adapted to communicate with the chamber 16 and the mouthpiece of the pipe by running along the longitudinal axis of the stem portion 14.

The bowl portion 12 is generally comprised of two equal halves, forming first 20 and second 22 bowl portions that are pivotably connected at the base 24 of the bowl 12 by suitable hinge means 26 or the like, which may comprise a customary hinge or a resiliant member suitably attached to each bowl section 20, 22, respectively such as by screws, adhesive, etc. The upper open end of the bowl 12 will further define at least one pair, and preferably two pair of releasably engagable closure or connecting means 28, such as a magnet 36 and complimentary iron-containing metal member 38.

In the preferred embodiment, each bowl section will contain one magnet and one iron-containing member, each disposed approximately 180° from each other adjacent the vertical longitudinal axial plane of each bowl section 20, 22, at the point where the bowl 12 is split. Each section 20, 22, will have the magnet 36 disposed opposite the iron-containing member 38 of the other bowl section, and vice versa. For ease of opening the bowl 12 it is preferred that the iron-containing members 38 be somewhat larger than the magnet 36. The bowl 12 may therefore be opened and closed easily by pivotal action of bowl section 22 at a 90° angle away from bowl section 20, and vice versa.

The tobacco cartridge 30 comprises a hollow walled cylinder 31 adapted to receive a quantity of tobacco 33 therein. The cartridge is non-combustable, i.e., metal, briar, plastic, and defines a hollow short shank portion 32 at the lower end thereof which is adapted to mate with channel 18. The shank portion 32 communicates with the interior of the cartridge cylinder 31. The cartridge 30 preferably has a cover 34 therefor, such as a hingably connected cover 34.

The cartridge 30 containing a quantity of tobacco 33 therein may easily be installed into the bowl 12 by separating the two bowl sections 20, 22, inserting shank 32 into channel 18, providing for frictional engagement thereof and thereafter bringing said two open bowl sections 20, 22 together. The procedure is repeated to remove the spent cartridge 30, thereby leaving a relatively clean pipe. The diameter of the cartridge 30 will be slightly less than the diameter of the bowl 12.

Since it is obvious that numerous changes and modifications can be made in the above-described details without departing from the spirit and nature of the invention, it is to be understood that all such changes and modifications are included within the scope of the invention.

What I claim as new is:

1. In a smoking pipe including a hollow bowl and stem portion having a mouth piece, said portion defining a bore communicating with said bowl and having a central axis perpendicular to the central axis of said bore, a two piece bowl formed of complimentary half sections, hinge means engaging said two half sections and being disposed along the underside of said bowl, at least one pair of releasably engaging connecting means adjacent the vertical longitudinal axis of said bowl sections, each member of said pair being disposed approximately 180° from the other member and on a different bowl section, a tobacco cartridge adapted to receive and contain tobacco comprising a hollow walled cylinder open at one end and including a hollow shank portion at the lower end of said cylinder, said shank portion being perpendicular to said bowl and said cylinder communicating with the interior of said cylinder and being adapted to mate with said bore whereby a draft may be created between said tobacco in said cartridge and the bore of said pipe.

2. A pipe as define in claim 1 wherein there are two pair of connecting means.

3. A pipe as defined in claim 1 wherein said cartridge is constructed of a substantially non-combustable material.

4. A pipe as defined in claim 1 where said cartridge includes a cover portion.

5. In a smoking pipe including a hollow bowl and stem portion having a mouth piece, said portion defining a bore communicating with said bowl, a two piece bowl formed of complimentary half sections, hinge means engaging said two half sections and being disposed along the underside of said bowl, at least one magnet and iron-containing metal member adjacent the vertical longitudinal axis of said bowl sections, each member of said pair being disposed approximately 180° from the other member and on a different bowl section, a tobacco cartridge adapted to receive and contain tobacco comprising a hollow walled cylinder open at one end and including a hollow shank portion at the lower end of said cylinder, said shank portion communicating with the interior of said cylinder and being adapted to mate with said bore whereby a draft may be created between said tobacco in said cartridge and the bore of said pipe.

* * * * *